US007891395B2

(12) United States Patent
Wild et al.

(10) Patent No.: US 7,891,395 B2
(45) Date of Patent: Feb. 22, 2011

(54) PROCEDURE AND DEVICE FOR STICKING OBJECTS

(75) Inventors: Hans-Peter Wild, Eppelheim (DE); Eberhard Kraft, Neckarbischofsheim (DE); Klaus Hägle, Kappel-Grafenhausen (DE); Berthold Willi, Heitersheim (DE)

(73) Assignee: Pioflex Kunststoff in Form GmbH & Co. KG, Denzlingen (DE)

( * ) Notice: Subject to any disclaimer, the term of this patent is extended or adjusted under 35 U.S.C. 154(b) by 0 days.

(21) Appl. No.: 12/135,665

(22) Filed: Jun. 9, 2008

(65) Prior Publication Data

US 2008/0311319 A1 Dec. 18, 2008

Related U.S. Application Data

(62) Division of application No. 11/499,137, filed on Aug. 3, 2006, now Pat. No. 7,395,927, which is a division of application No. 10/394,526, filed on Mar. 21, 2003.

(30) Foreign Application Priority Data

Mar. 28, 2002 (EP) ..... 02007421

(51) Int. Cl.

| | |
|---|---|
| ***G05G 15/00*** | (2006.01) |
| ***B26D 5/26*** | (2006.01) |
| ***B29C 65/52*** | (2006.01) |
| ***B32B 37/12*** | (2006.01) |
| ***B32B 37/26*** | (2006.01) |
| ***B32B 38/04*** | (2006.01) |
| ***B32B 41/00*** | (2006.01) |

(52) U.S. Cl. ..... 156/354; 156/356; 156/537; 156/539; 156/547

(58) Field of Classification Search ..... 156/230, 156/231, 234, 235, 237, 238, 242, 244.11, 156/244.18, 247–250, 289, 290, 291, 350, 156/356, 361, 362, 363, 543, 547, 548, 578, 156/354, 391, 537–539, 567, 571; 118/663, 118/668, 45

See application file for complete search history.

(56) References Cited

U.S. PATENT DOCUMENTS 2,197,845 A 4/1940 Ward ..... 206/820

(Continued)

FOREIGN PATENT DOCUMENTS

EP 0568293 11/1993

(Continued)

OTHER PUBLICATIONS

English Translation of EP 0,585,532.*

(Continued)

*Primary Examiner*—Philip C Tucker
*Assistant Examiner*—Sing P Chan
(74) *Attorney, Agent, or Firm*—Stroock & Stroock & Lavan LLP

(57) ABSTRACT

The invention relates to a method for sticking, a container, a pocket tape, a method for the production of a pocket tape, a device for the production of a pocket tape, a method for the production of an adhesive tape, an adhesive tape and a device for the production of an adhesive tape. The invention is characterised in that adhesive zones are spaced from one another by non-adhesive zones.

8 Claims, 7 Drawing Sheets

U.S. PATENT DOCUMENTS

| | | | | | |
|---|---|---|---|---|---|
| 2,940,884 | A | | 6/1960 | Rowland | 206/447 |
| 3,056,493 | A | | 10/1962 | Berryman | 206/484 |
| 4,119,843 | A | * | 10/1978 | Hinds | 250/222.1 |
| 4,394,904 | A | | 7/1983 | Larimore | 206/447 |
| 4,469,291 | A | * | 9/1984 | Treiber et al. | 242/412.2 |
| 4,572,758 | A | | 2/1986 | Wild | |
| 4,959,008 | A | | 9/1990 | Wasulko | |
| 5,618,347 | A | * | 4/1997 | Clare et al. | 118/314 |
| 5,979,142 | A | | 11/1999 | Kraft | |
| 6,074,480 | A | | 6/2000 | Kakuta | |
| 2004/0195136 | A1 | | 10/2004 | Young | 206/484 |

FOREIGN PATENT DOCUMENTS

| | | | |
|---|---|---|---|
| EP | 0585532 | | 3/1994 |
| EP | 864370 | A1 * | 9/1998 |
| EP | 0 909 710 | A1 | 4/1999 |
| EP | 1095862 | | 5/2001 |
| EP | 1238921 | A2 | 9/2002 |
| JP | 61152537 | | 7/1986 |
| JP | 06-027520 | | 2/1994 |
| JP | 10-244770 | | 9/1998 |
| JP | 11-193011 | | 7/1999 |
| JP | 61-105682 | | 9/2006 |
| WO | WO 02/06124 | | 1/2002 |

OTHER PUBLICATIONS

European Search Report for European Appln. No. 02007421.7 dated Dec. 5, 2002. Search report available in divisional application No. 11/499,137.

Translation of the Official Action and Prior Art Report for the Polish Patent Application No. P-359382 dated Feb. 2, 2010.

Official Action from Japan Patent Office on Jan. 19, 2010.

* cited by examiner

PROCEDURE AND DEVICE FOR STICKING OBJECTS

CROSS-REFERENCE TO RELATED APPLICATIONS

This application is a divisional patent application of U.S. patent application Ser. No. 11/499,137, issued as U.S. Pat. No. 7,395,927, filed Aug. 3, 2006 and entitled "POCKET TAPE WITH ALTERNATING ADHESIVE AND NON-ADHESIVE ZONES AND OVERLYING CARRIER TAPE", which is a divisional patent application of U.S. patent application Ser. No. 10/394,526, filed Mar. 21, 2003, and entitled "PROCEDURE AND DEVICE FOR STICKING OBJECTS", which claims foreign priority benefit under European Patent Office Application No. 02007421.7, filed on Mar. 28, 2002, and entitled "PROCEDURE AND DEVICE FOR STICKING OBJECTS", the contents of all being incorporated in entirety by reference herein.

BACKGROUND OF THE INVENTION

Figure 10:
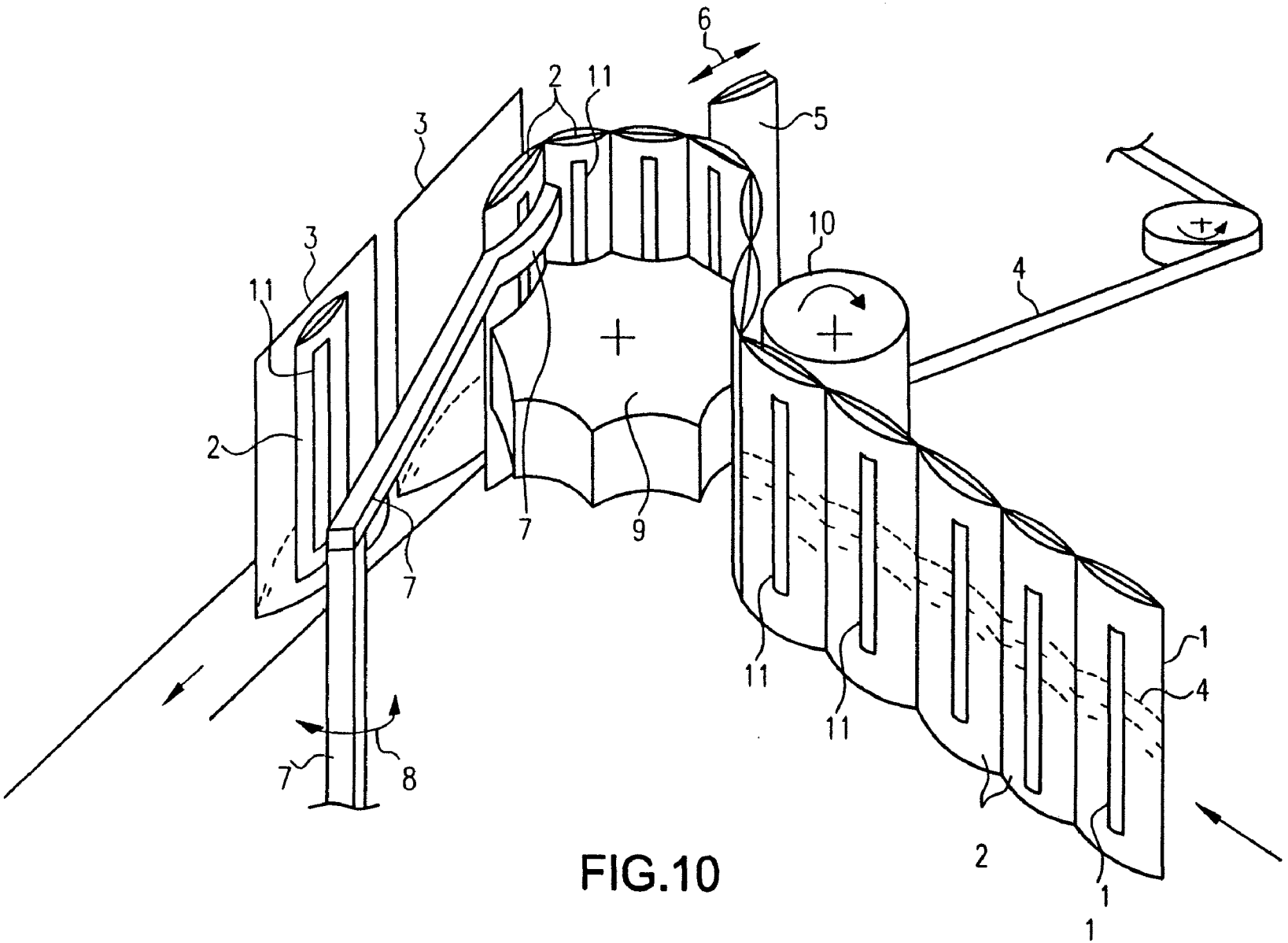

From the state of the art a method is known for applying drinking straws to film pouches, as explained in the following based on FIG. 10. Drinking straws 11 are packed into film pockets 2, which are already joined and form a pocket tape 1. On the pocket tape there is an adhesive film layer, which is covered by a carrier tape 4 (also termed cover tape or liner). The carrier tape 4 is pulled off at a diversion roller 10 so that the adhesive location is exposed. The individual straw pockets 2 are cut off singly from the incoming pocket tape 1 further along in the process by a cutting stage with a knife 5. The knife can here move to and fro and/or also rotate. With appropriate devices, e.g. a vacuum opening in the diversion pulley 9, the pockets 2 are held on the diversion pulley 9. A pressure device 7, which in FIG. 10 is equipped as a lever, presses the pocket 2 with the drinking straw 11 against the drinks pouch 3 which is transported past the device for mounting the drinking straws. In this way the drinks pouches 3 are fitted with drinking straws 11 packed in pockets 2 by sticking them to the pockets 2.

SUMMARY OF THE INVENTION

The object of the invention is to suggest further improvements for fast and fault-free mounting, in particular providing methods, devices and objects which enable an improvement to this method and an improvement to the products manufactured by the method.

With the aid of the adhesive tape according to the invention, which incorporates adhesive zones, which are spaced out by non-adhesive zones in the direction along the adhesive tape, it is possible to produce a pocket tape according to the invention with which non-adhesive zones are formed in the sections between the centers of two adjacent pockets. With a pocket tape of this type according to the invention, it is possible to carry out a method according to the invention, with which pockets are stuck to containers and during which a knife, which cuts off pockets from the pocket tape, does not come into contact with the adhesive. Consequently, clogging of the knife with adhesive, which would impair the service life of the blade, is prevented.

For the invention it is advantageous if an adhesive with high initial adhesive force is used. The adhesive tape according to the invention, the pocket tape according to the invention and the container according to the invention all have the advantage that the process can be implemented with a soft adhesive which can exhibit this sort of high initial adhesive force. Due to the fact that a cover of the adhesive (e.g. a pocket or a carrier tape) with the container according to the invention and also with the embodiments of the pocket tape and adhesive tape according to the invention protrudes over the original adhesive zone, a certain flow of the adhesive can be accepted without the adhesive escaping to the outside.

With the adhesive tape according to the invention it is possible to apply single adhesive locations to any objects. This occurs due to the fact that the adhesive of one adhesive zone is applied to the object together with the carrier tape. Due to the covering carrier tape, it is possible to apply pressure. Then, the carrier tape can be easily removed. This takes place due to the fact that the carrier tape, from which the adhesive has already been transferred to an object, can be pulled off, releasing the carrier tape from the last stuck adhesive zone. Also when the carrier tape has been parted, it is easily possible to grip the carrier tape and pull it off, because there are sections at which the carrier tape does not adhere to the object. The tedious search for a corner on which the carrier tape can be gripped and pulled off, which is familiar with commercially available double-sided adhesive tapes, is not needed. After removal of the carrier tape, the adhesive remains on the object. The adhesive tape according to the invention can therefore be realised as double-sided adhesive tape or also as transfer adhesive tape.

BRIEF DESCRIPTION OF THE INVENTION

Figure 3:
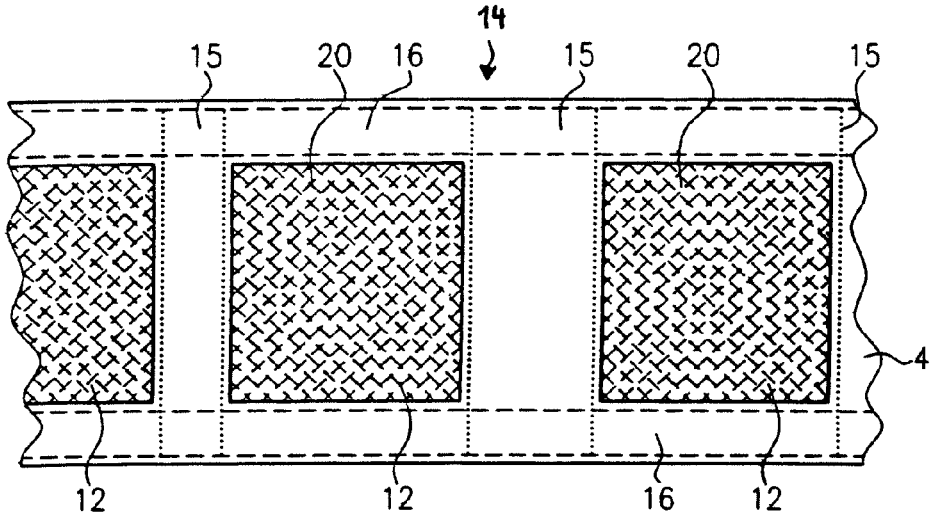
Figure 5:
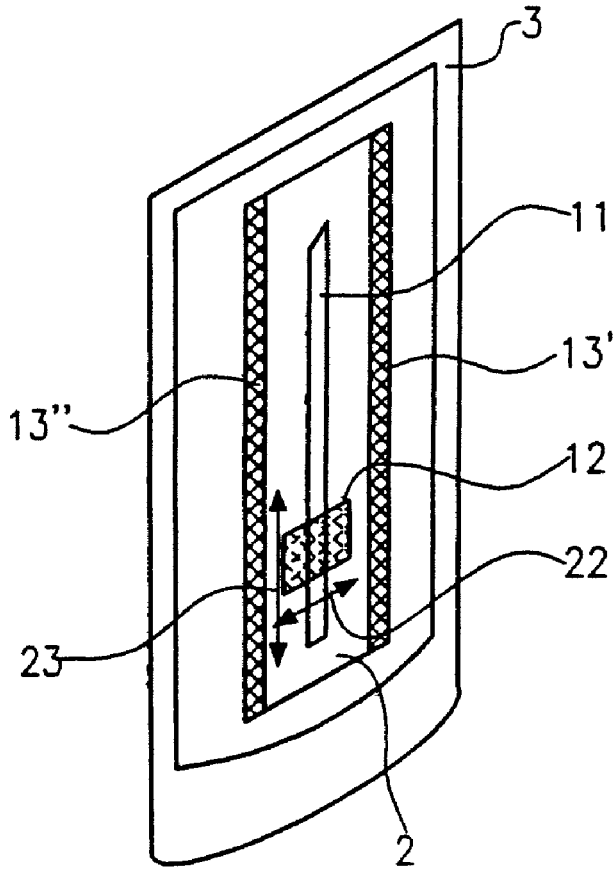
Figure 6:
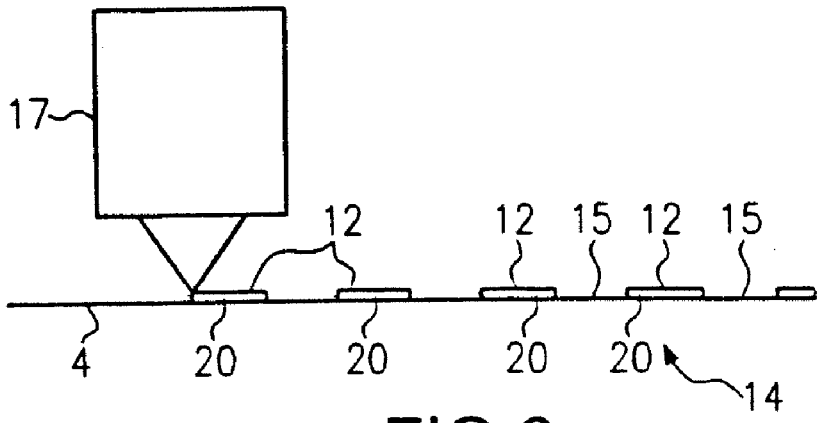
Figure 7:
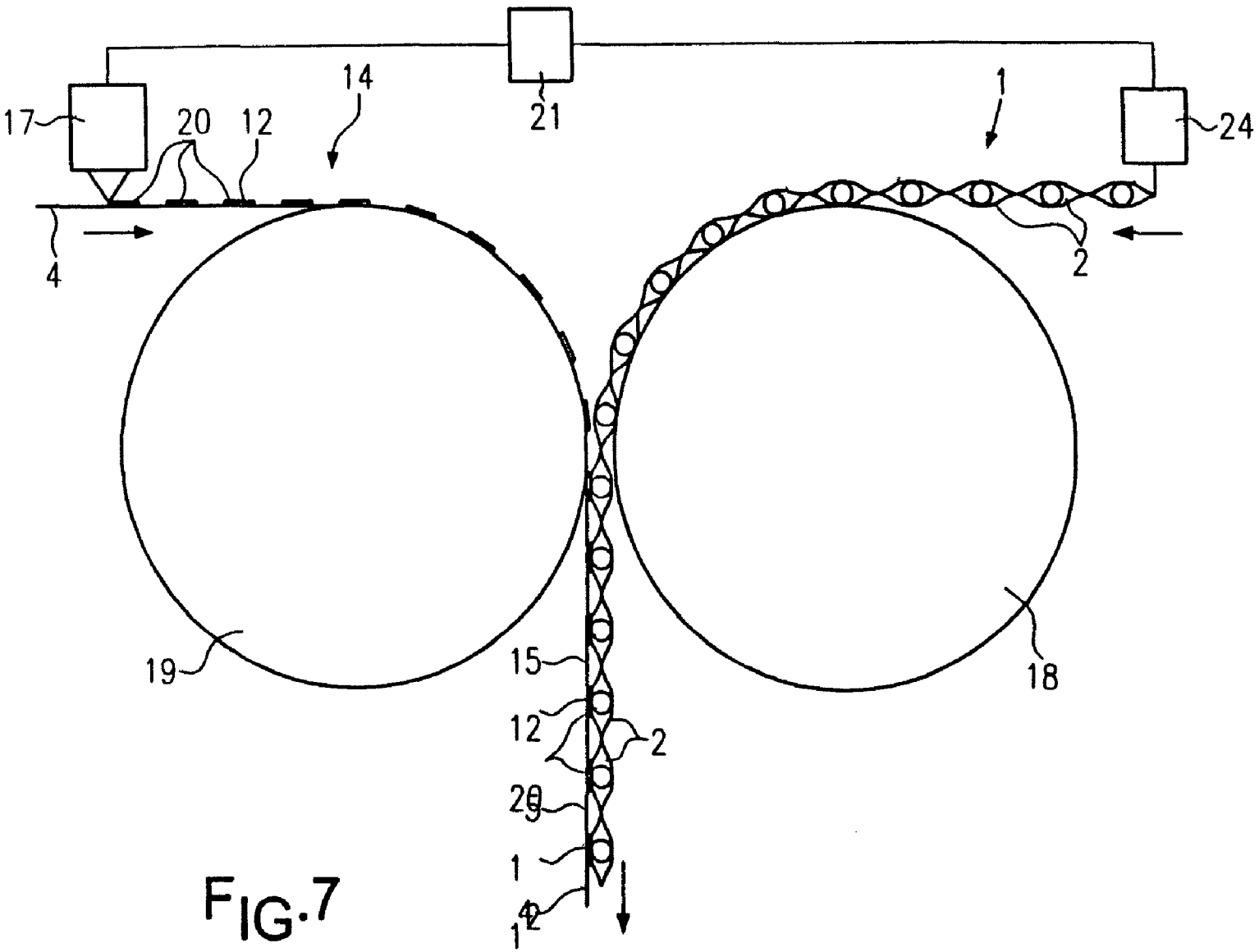
Figure 8:
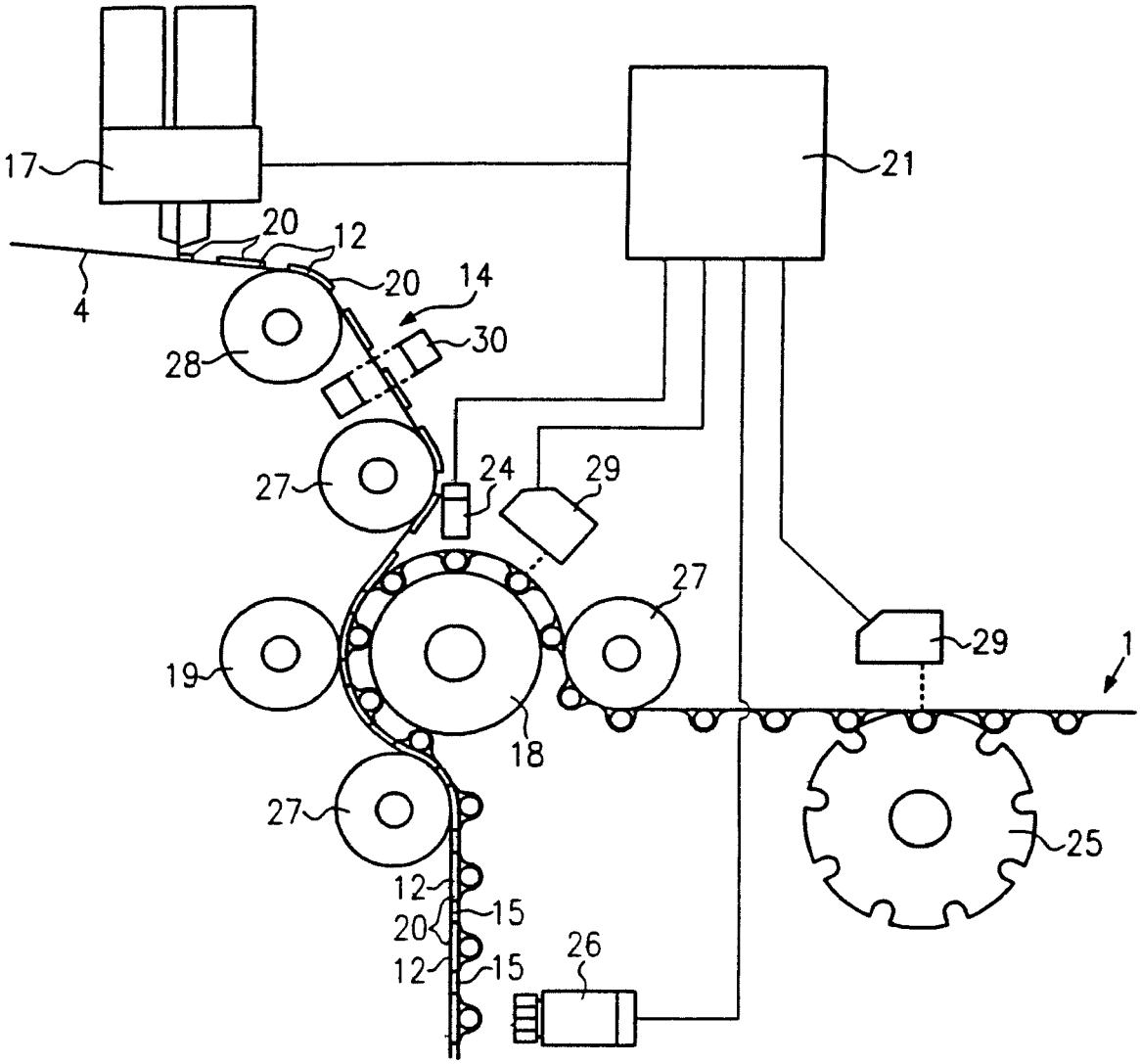
Figure 9:
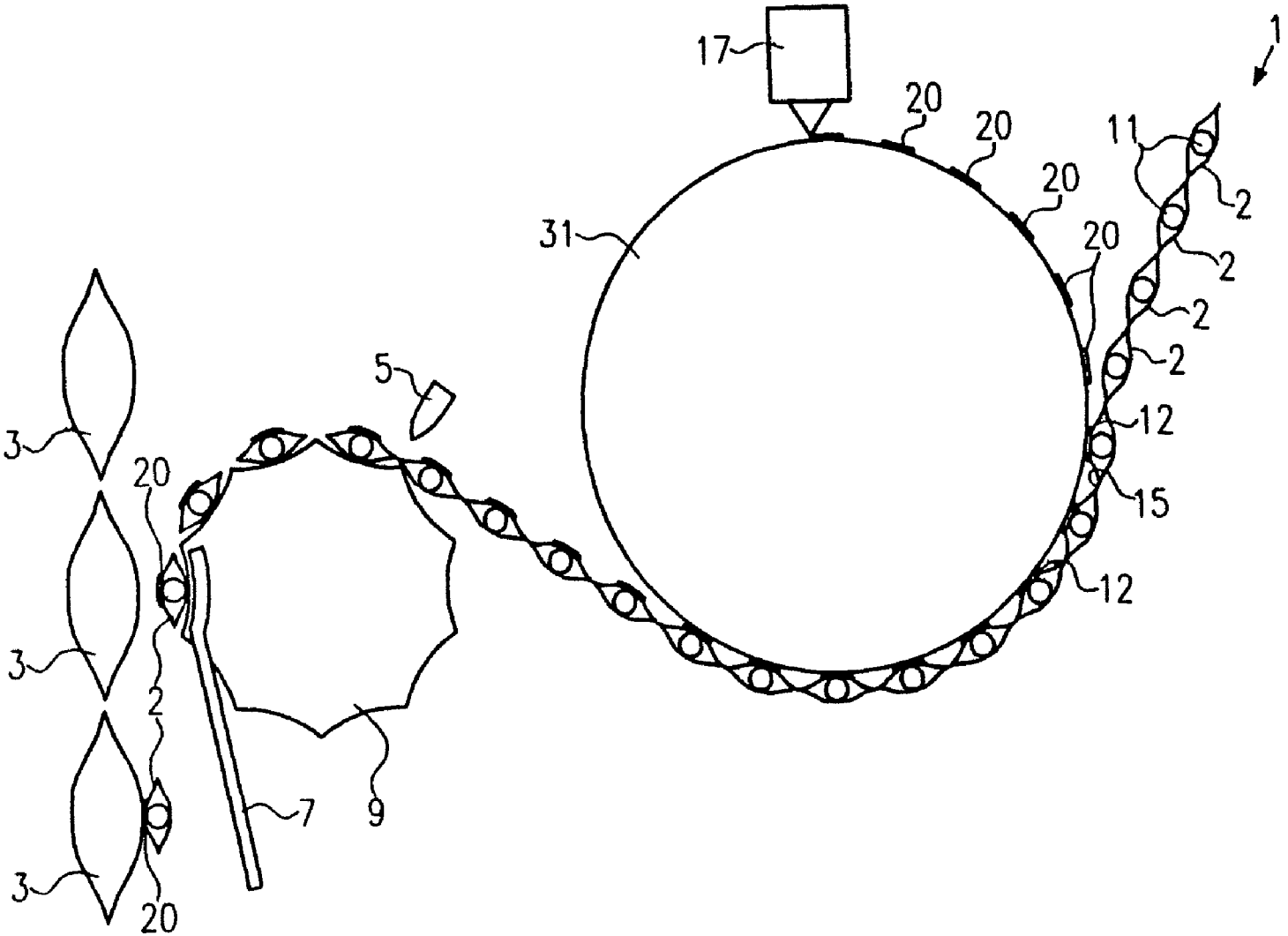

Particularly advantageous embodiments of the devices, methods and objects are explained based on the enclosed figures. Here, FIG. 1 shows a schematic illustration of a pocket tape according to the invention, FIG. 2 shows various schematic illustrations of the embodiments of adhesive zones according to the invention, FIG. 3 shows a schematic illustration of an adhesive tape according to the invention, FIG. 4 shows a schematic illustration of various states of a device during the realisation of a method according to the invention, FIG. 5 shows a schematic illustration of a container according to the invention, FIG. 6 shows a schematic illustration of a device according to the invention for the production of an adhesive tape according to the invention, FIG. 7 shows a schematic illustration of a device according to the invention for the production of a pocket tape according to the invention, FIG. 8 shows a schematic illustration of a device according to the invention for the production of a pocket tape according to the invention, FIG. 9 shows a schematic illustration of a device according to the invention for sticking a pocket tape, FIG. 10 shows a device according to the state of the art.

Figure 1:
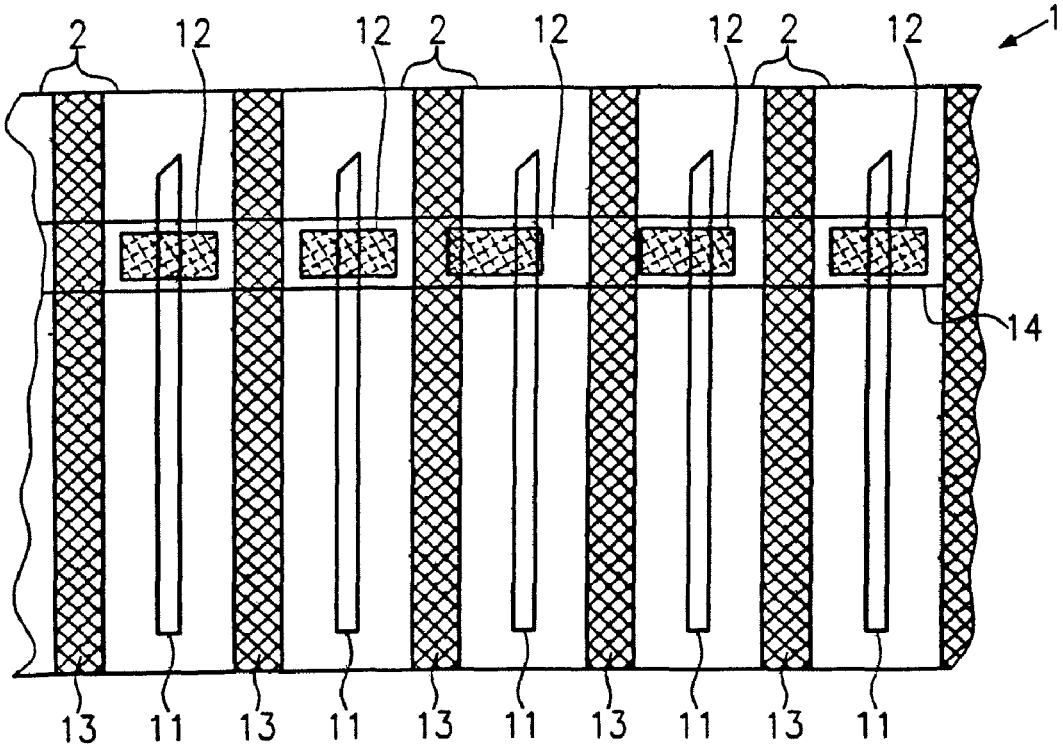
Figure 2A:
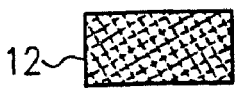
Figure 2B:
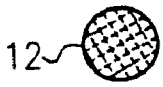
Figure 2C:
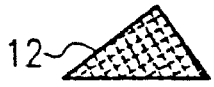
Figure 2D:
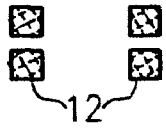
Figure 2E:
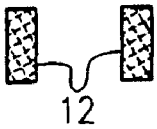
Figure 2F:
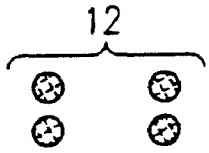
Figure 2G:
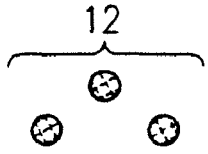
Figure 2H:
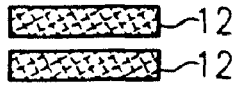

In FIG. 1 a pocket tape 1 is illustrated. The pocket tape consists of a film material and exhibits pockets 2 aligned parallel to one another. The pockets 2 on the pocket tape 1 could also be arranged longitudinally behind one another.

Each of the pockets 2 contains one or more drinking straws 11. Instead of drinking straws, pieces of cutlery, for example made of plastic, stirring tools, accessory parts or small gifts could be contained in the pockets, whereby, also here, one or more of these sorts of objects can be accommodated in a pocket. For the foodstuffs field the pockets 2 have the advantage that an hygienically clean packaging of the straws 11 or other objects is possible in the pockets 2.

The pockets 2 arise due to the fact that in FIG. 1 a thin film band is provided in front of and behind the drawing plane, between which the drinking straw 11 is situated. The films in front of and behind the drawing plane are welded together in the sections 13 to separate the drinking straws 11 from one another. Furthermore, the sections 13 have the function that when a single pocket 2 on the pocket tape 1 is cut off in the sections 13, no external air can access the drinking straw 11 so that it remains hygienically clean even after the pocket 2 is cut off.

Adhesive zones 12 are provided along the pocket tape 1. The adhesive zones 12 are located in the longitudinal direction of the pocket tape 1, mainly in the centre of each pocket 2. As illustrated in FIG. 1, slight deviations from the exact position of the adhesive zones 12 are however possible in relation to the pocket 2.

It is also possible according to the invention that, as shown in the center of FIG. 1, the adhesive zone 12 extends up to the section 13 to the left of the center pocket 2.

As shown in FIG. 1, an adhesive zone 12 is provided for each pocket 2. However, a number of adhesive zones 12 can also be provided for each pocket 2. Also, a number of carrier tapes 4 can be provided.

The adhesive zones 12 are repeated, mainly periodically, along the pocket tape 1. Also, the formation of the pockets 2 and the sections 13 in the pocket tape 1 is repeated periodically. Ideally, the periodicity of the adhesive zones 12 and the periodicity of the pockets 2 are the same.

The material enveloping the drinking straws 11 may be of any suitable plastic or also paper, textile, foil or film material.

The adhesive which is applied in the adhesive zones 12 can be any suitable adhesive. Adhesives with a high initial adhesive force are advantageous. Adhesives can even be applied which exhibit a certain flow property, so that a good adhesive force is produced. Such adhesives are also termed soft adhesives. An example of an applicable sort of adhesive is "hot-melt" adhesive.

The sections 13 in FIG. 1 can also extend according to the invention right up to each drinking straw 1, so that the main part of the pocket tape 1 consists of sections 13. The adhesive zone 12 can also extend from one section 13 over the drinking straw up to the adjacent section 13.

For cutting the pocket tape 1 up into individual pockets 2, it is advantageous if the sections 13 are large, because then a larger area arises in which the cutting process for parting a pocket 2 from the pocket tape 1 can take place.

In FIG. 2 embodiments of the adhesive zone 12 according to the invention are illustrated. Possible forms of the adhesive zone 12 are square, rectangular, circular, triangular or any other regular or irregular shape. It is also possible to divide up the adhesive zone 12 into a number of individual adhesive zones, each with the previously mentioned shapes. Then the adhesive zone 12 can be subdivided into two, three, four or more adhesive zones.

In FIG. 3 an embodiment of an adhesive tape 14 according to the invention is illustrated. This type of adhesive tape 14 can be advantageously provided in the pocket tape 1, as shown in FIG. 1. Adhesive zones 12 are provided on a carrier tape 4. The various adhesive zones 12 are separated from one another by non-adhesive zones. In the embodiment illustrated, the non-adhesive zones 15 extend laterally from the upper edge to the lower edge of the carrier tape 4. The adhesive zones 12 along the carrier tape 4 are spaced from one another by the non-adhesive zones 15. The non-adhesive zones 15 can be formed by the omission of adhesive 20. Also, it is possible according to the invention to form the non-adhesive zones 15 by rendering the adhesive ineffective, for example, by irradiation or subjecting the adhesive to certain chemicals, vapours, gases, dusts, etc. Also, the adhesive 20 can be covered by a layer to create non-adhesive zones 15.

On the upper and lower edges of the carrier tape 4 non-adhesive areas 16 are provided which extend along the carrier tape 4. Consequently, the carrier tape 4 protrudes in all directions over the areas of the adhesive zone 12, whereby the adhesive can flow a little without it escaping to the outside.

As illustrated in FIG. 3, the sizes of the adhesive zone 12 and the non-adhesive zone 15 need not always be identical, but they should be substantially similar.

Figure 4A:
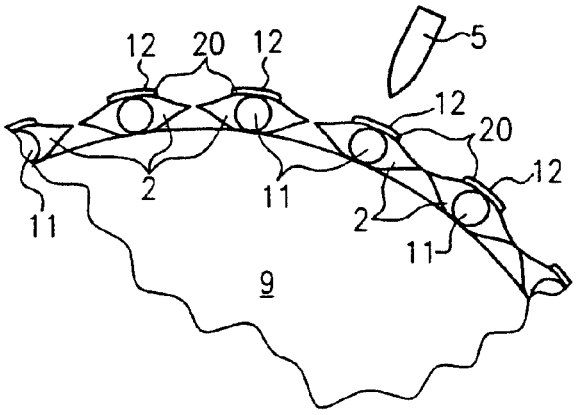
Figure 4B:
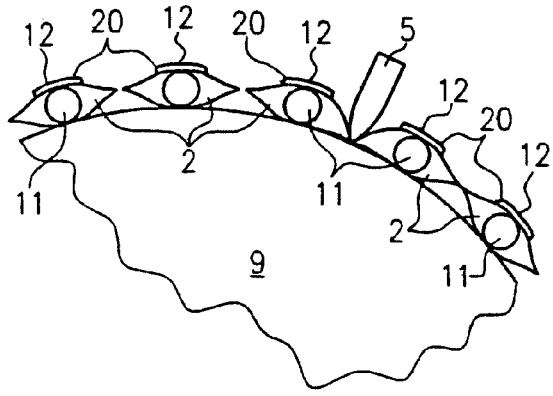

Based on FIGS. 4 and 10, an embodiment of the method according to the invention for sticking a pocket 2 on a container is explained. A pocket tape 1 according to the invention, for example the pocket tape 1 described in FIG. 1, is passed to a device, as shown in FIG. 10, for sticking pockets onto drinks pouches. The carrier tape 4 is removed at a deviation roller 10 due to the fact that it is pulled off and transported away. The deviation roller 9, as shown in FIG. 10, is schematically illustrated in a plan view in FIGS. 4*a* and 4*b*. In FIGS. 4*a* and 4*b* the pocket tape 1 fed in from the right in each case is illustrated close to the deviation roller 9. The pocket tape 1 is composed of consecutively arranged pockets 2, each of which contains a drinking straw 11. On the outside of the pocket tape 1 adhesive zones 12 are illustrated in which adhesive 20 is located on the pocket tape 1. At a point in time, as illustrated in FIG. 4*a*, at which an adhesive zone 12 with adhesive is located in front of the knife 5, a cutting process is not carried out. With the state as in FIG. 4*b* where the knife 5 has no adhesive zone 12 in front of it, the knife can move onto the deviation roller 9 so that a pocket 2 is cut off from the pocket tape 1 by the sharp front blade edge. The cutting movement of the knife is controlled in the method by a suitable controller, so that the cut occurs between the pocket centers. The cut takes place advantageously in the sections 13 of the pocket tape 1. The control device receives the information mechanically, electrically, optically or in some other form, of when the cutting process is to be carried out in dependence of the position of a pocket 2 and/or an adhesive zone 12. The deviation roller 9, as shown in FIG. 4, can also be formed as a deviation pulley, as illustrated schematically in FIG. 10. The individual pockets are then placed in the indentations in the deviation pulley 9. The control of the cutting process can also be triggered or controlled by the rotational position of the deviation pulley or the deviation roller 9.

The pockets 2 present to the left of the knife 5 are then all singled out and can be held on the deviation roller 9 by appropriate devices, such as for example, a vacuum opening or other clamping devices.

Due to the fact that the knife 5 separates a pocket 2 from the pocket tape 1 at a location at which no adhesive of an adhesive zone 12 is present, the knife 5 does not make contact with the adhesive of the adhesive zones 12. Consequently, clogging of the knife by adhesive can be largely eliminated. This type of clogging can disadvantageously shorten the service life of the knife 5 or lead to operational faults. With the method according to the invention, using a pocket tape 1 according to the invention with an adhesive tape 14 according to the invention, the service life of the knife, i.e. the time during which a knife cuts without problems, can be significantly increased.

Once the pockets 2 have been singled out, the pockets 2 are pressed against drinks pouches 3 with a pressure device 7, as illustrated in FIG. 10.

A further embodiment of a method according to the invention for sticking a pocket 2 to a container 3 consists of applying the adhesive 20 with a head, as illustrated for example in FIG. 6, on the pocket tape 1 and then cutting a pocket 2 from the pocket tape 1, as described above and sticking the pockets 2. A carrier tape 4 may then be omitted. A roller 31 can also be employed on which the adhesive 20 is applied and with which the adhesive is then applied to the pocket tape, for example, by applying pressure. The surface of the roller is here advantageously at least partially poorly adhesive. For this, the roller can, for example, exhibit a surface coated or provided with silicone, Teflon, rubber or an anti-adhesion layer, e.g. anti-adhesion paint coating. The roller acts as a transfer roller.

The adhesive is advantageously immediately applied to the roller 31 in adhesive zones 12 spaced out by non-adhesive zones 15 and these zones are transferred to the pocket tape 2. The adhesive zones 12 are here positioned on the pockets 2 on the pocket tape 1 such that the pockets 2 can be cut off from the pocket tape 1 in the section 13 in the section of the non-adhesive zones 15. With this method a circulating carrier tape 4 can, so to say, be replaced by a roller, whereby the reliability can be improved.

A device for realising the method is illustrated in FIG. 9. A head 17 is arranged adjacent to a roller 31 and can apply adhesive 20 intermittently to the roller 31. A pocket tape 1 can be fed past the roller 31 so that the adhesive 20 is transferred from the roller 31 to the pocket tape 1. Furthermore, downstream the roller 31 a cutting device 5 is provided to separate the pockets 2. The pockets 2 can be stuck to the containers 3 with a pressure device 7. The head 17 can be controlled such that the adhesive 20 is positioned on the pocket tape 1 such that adhesive zones 12 are formed which are placed approximately in the centre of a pocket 2. Consequently, the pockets 2 can be cut off in the region of the non-adhesive zones 15 from the pocket tape 1 in the section 13. The adhesive zones 12 are spaced out by non-adhesive zones 15. For the control of the head 17 control devices 21 and signal or pulse transducers 23, 24, 25, as illustrated in FIGS. 7 and 8 and as described below, are provided advantageously. Also an inspection camera as shown in FIG. 8 can be employed advantageously.

The container according to the invention is shown enlarged in FIG. 5. Here, reference is made to a drinks pouch as an example of a drinks vessel, fluids container or other package. On the drinks pouch 3 is located a pocket 2 in which a straw 11 is enclosed. Furthermore, an adhesive zone 12 is illustrated which extends centrally in relation to the direction lateral to the pocket, i.e. in the direction of the double arrow 22. In relation to the longitudinal direction of the pocket 2, the adhesive zone 12 can be provided at any location. The preferred position can depend on the container onto which the pocket is to be stuck. With film pouches filled with liquid, a position in the lower section may be preferred.

To the right and left of the drinking straw 22 parts 13' and 13" of zones 13 on the pocket tape 1 can be seen. Parts 13' and 13" have arisen through the cutting off of pockets 2 from the pocket tape 1.

Due to the fact that the non-adhesive sections 15, as shown in FIG. 3, were used with the adhesive tape 14 of the pocket tape 1, the adhesive zone 12 in the direction of the double arrow 22 does not extend to the edge of the pocket 2. As a result and due to the fact that the pocket 2 is longer in its longitudinal direction than the width of the carrier tape 4, the pocket 2 protrudes beyond the adhesive zone 12 in each of the directions 22 and 23. Without the non-adhesive zone 15 the adhesive zone 12 would extend to the edges of the pocket 2 in the direction of the double arrow 22, as in the state of the art.

Due to the fact that the pocket 2 protrudes beyond the adhesive zone 12 in each of the directions 22 and 23, a soft adhesive can also be used which can also flow slightly without the adhesive escaping from between the pocket 2 and the film pouch. Consequently, an adhesive can be used with which a substantially higher tack value, i.e. a higher initial adhesive force is achieved.

A device according to the invention for the production of an adhesive tape 14 according to the invention is illustrated in FIG. 6. A head 17 is provided to transfer adhesive 20 in portions to a carrier tape 4. The device according to the invention for the production of an adhesive tape 14 according to the invention also incorporates a device which feeds the carrier tape 4. This can be, for example, a take-off spooling device. Furthermore, the device according to the invention includes means for transporting the carrier tape 4 away under the head 17. These means are not illustrated in FIG. 6.

Through rollers or other deviation devices advantages can be obtained in that the carrier tape 4 has contact with the head 17. The contact may be very slight.

Also it is possible according to the invention that the carrier tape 4 is separated from the head 17 and the adhesive is applied, e.g. sprayed on, over a certain distance.

A method according to the invention for the production of the adhesive tape 14 according to the invention is explained based on FIG. 6. A device, which is not shown, for feeding the carrier tape 4 supplies the incoming carrier tape 4 from the left in FIG. 6. The carrier tape 4 can for example be wound off a roll.

While the carrier tape 4 runs past the head 17, adhesive 20 is intermittently output by the head 17 and applied to the carrier tape 4. This produces adhesive zones 12 and non-adhesive zones 15.

After applying the adhesive 20 in the adhesive zones 12 on the carrier tape 4, the adhesive tape 14 so produced then runs to the right out of FIG. 6. It can then be directly used further, for example, in the production of a pocket tape 1 according to the invention or it can be rolled up. If the adhesive tape 14 according to the invention is rolled up, then it is advantageous if a carrier tape 4 is used which has poor adhesion on both sides. It is also advantageous if one side has clearly worse adhesion properties than the other so that when winding off the rolled up adhesive tape 14 according to the invention, the adhesive 20 always remains in the adhesive zones 12 on one side of the carrier tape 4.

If the adhesive tape 14 according to the invention, which is produced according to the invention, is used immediately, then it is sufficient if the carrier tape 4 has poor adhesion properties on only one side.

The required poor adhesion can for example be obtained by a coated carrier tape material. Especially advantageous are siliconised carrier tapes 4. Also Teflon or other anti-adhesion coatings can be used, e.g. anti-adhesion paints. Also, carrier tapes can be used which consist completely of a low-adhesion material.

During the production of the adhesive tape 14 according to the invention it is possible to apply adhesive to adhesive zones 12 with a number of heads or with a number of adhesive application elements in parallel adjacent to one another on a carrier tape material running off a master roll. Thereafter, the carrier tape material is cut up into single carrier tapes 4. It is also possible according to the invention to make individual carrier tapes 4 from a master roll and to then provide them with the adhesive 20 in the adhesive zones 12.

A device according to the invention for producing a pocket tape 1 according to the invention is illustrated in FIG. 7. Rollers 18 and 19, which may be of the same or different size, are provided to accommodate a pocket tape 1 and a carrier tape 4 running in between them and to press them together. Furthermore, a device 17 similar to that in FIG. 6 is provided to apply adhesive 20 to the carrier tape 4 in the adhesive zones 12. The device according to the invention for producing a pocket tape 1 according to the invention must be so equipped that the adhesive zones 12 mainly meet on a pocket 2 in the center of the direction along the pocket tape 1. In particular it is advantageous if the non-adhesive zones 15 meet between the adhesive zones 12 on those parts of the pocket 2 which belong to the sections 13 (see FIG. 1) in which the pockets 2 can be later cut off from the pocket tape 1.

With the device schematically illustrated in FIG. 7 this is achieved in that a control device 21 is provided which is connected to a signal transducer 24 and the head 17. The signal transducer 24 can acquire a certain position of a pocket 2. The signal transducer 24 may be equipped mechanically, electronically, optically or in some other manner. A grooved wheel, in which the drinking straws 11 lie, may be advantageous for the formation arrangement of the signal transducer. The signal transducer 24 signals to the control device 21, for example, the start, center or end of a pocket 2 or of a drinking straw 11 in the pocket 2. The control device 21 can then signal the head 17 to apply the adhesive 20. Consequently, it is possible to match the adhesive zones 12 and the non-adhesive zones 15 exactly to the relevant pocket 2 of the pocket tape 1.

According to the invention it is however possible to synchronise the application of the adhesive 20 by the head 17 to a timed cycle whereby the cycle can be made dependent on the speed of the carrier tape 4 or of the pocket tape 1.

The amount of adhesive 20 applied per adhesive zone 12 is advantageously preset.

Instead of using two deviation rollers 18 and 19 to join the carrier tape 4 and the pocket tape 1, it is also possible to use only one roller for the deviation of either the carrier tape 4 or the pocket tape 1 or even to use no roller and the feeding together of the pocket tape 1 and the carrier tape 4 is then achieved in that a constriction point is provided through which the two tapes 1 and 4 are pulled.

A further embodiment of the device according to the invention for the production of a pocket tape 1 according to the invention arises due to the fact that the head 17 does not apply the adhesive to the carrier tape 4, but is instead arranged such that the adhesive 20 is applied to the pocket tape 1. The covering of the adhesive zones 12 with the carrier tape 4 occurs however analogous to the device described above. Also here, the adhesive application by the head 17 can be triggered by the passage of single pockets or pocket contents or it can also be synchronised to a timed cycle whereby the cycle depends on the speed of the carrier tape or the pocket tape 1.

FIG. 8 also illustrates a device according to the invention for the production of a pocket tape 1 according to the invention. A head 17 is provided to transfer adhesive 20 to a carrier tape 4. The carrier tape 4 is guided or transported through diversion rollers 28. Devices for clamping the carrier tape 4 can also be provided. The device also incorporates one or more diversion rollers 27 for guiding a pocket tape 1. Rollers 18 and 19 are provided to bring the carrier tape 4 and the pocket tape 1 together and so to stick them together with the adhesive. The two tapes are pressed together by the rollers 18 and 19.

Furthermore, a grooved wheel 25 is provided whereby the drinking straws 11 of the pocket tape 1 can be accommodated in the grooves. Consequently, a feed of drinking straws is possible in which the distance between adjacent drinking straws and/or the rate or cycle with which the drinking straws 11 or the pockets 2 are fed can be adjusted. Also, it is alternatively or additionally possible that the grooved wheel 25 functions as a pulse transducer, whereby a passing drinking straw 11 triggers a pulse.

A checking device 30 for checking the carrier tape is provided downstream from the head 17. The checking device 30 can, for example, be provided to just check for the presence and/or the lateral position of the carrier tape 4 or the adhesive tape 14. Also it can check the properties of the adhesive tape 14, such as for example the size and/or quality or the presence of adhesive zones 12 on the carrier tape 4. The checking device 30 can advantageously also be connected to the control device 21 and when faults are found and depending on the fault it can initiate suitable measures, such as switching off, warning, adjusting rollers on a clamping device or make adjustments to other rollers or the head 17 or similar.

Furthermore, a control device 21 is provided which is connected to one or more pulse transducers and the head 17. The control device 21 can control the head such that it applies adhesive 20 targeted on the carrier tape 4. Devices 29 for guiding the pocket tape 1 are provided at suitable positions.

A pulse transducer 24 is provided at the roller 18 and formed such that it detects passing drinking straws. To detect a drinking straw the pulse transducer 24 may for example be equipped optically, mechanically, electronically or in some other way. It is connected to the controller 21 and can pass on these control pulses.

An inspection camera 26 which is connected to the control device 21 is provided to take pictures of the finished pocket tape 1. From the pictures various parameters can be determined in the control device 21 using suitable image processing and image evaluation software. These include advantageously the size of the non-adhesive zone 15, the size of the adhesive zone 12, the correct position of the adhesive zone 12 in relation to the drinking straw 11 and a correct distance between the adhesive zones 12.

The inspection camera 26 can be used for monitoring and control purposes. For example, using the inspection camera 26, it is possible to check the relative position of the adhesive zone 12 in relation to a pocket 2 on the pocket tape 1 during the operation and then to possibly readjust the adhesive application by the head 17 with respect to time, i.e. to delay or speed up in comparison to the previous rate.

With the device in FIG. 8 it is also possible according to the invention that the head 17 applies the adhesive 20 in the adhesive zones 12 on the pocket tape 1.

In the following methods according to the invention for producing a pocket tape 1 according to the invention are explained. With both methods a carrier tape 4 and a pocket tape 1 are fed in. The pocket tape 1 can, for example, be pulled from a storage container or be wound from a roller. The carrier tape 4 can similarly, for example, be wound off a reel. With both methods the carrier tape 4 and the pocket tape 1 are also brought into contact with one another by appropriate devices 18 and 19. A signal transducer 23, 24, 25 signals the passing of a certain part of the pocket tape 1 to the controller 21. The control device 21 then controls the head 17 such that it transfers adhesive 20 to the adhesive zones 12. With a method according to the invention the adhesive can be output onto the carrier tape 4 and with another method according to the invention the adhesive can be output to the pocket tape 1. If the adhesive is applied to the pocket tape 1, then it is applied through the control device 21 such that it is applied in the direction longitudinal to the pocket tape 1 mainly in the centre of each pocket 2. The adhesive-free zones 15 lie mainly in the section which is labelled with 13 in FIG. 1, i.e. in the section in which a pocket 2 can be cut off from the pocket tape 1.

If the adhesive is applied by the head 17 onto the carrier tape 4, then the adhesive application takes place in the adhesive zones 12 so that when the carrier tape 4 and the pocket tape 1 are brought together, the adhesive zones 12 mainly lie in the longitudinal direction of the pocket tape 1 centrally with reference to the relevant pocket 2. The non-adhesive zones 15 are mainly positioned in the sections 13 of the pocket tape 1. The control of the head 17 for the application of the adhesive 20 in the adhesive zones 12 can also occur through the setting of a timed cycle, whereby the cycle depends on the speed of the carrier tape 4 or the pocket tape 1.

The pocket tape 1 according to the invention so produced can then be inspected by an inspection camera 26 as described above.

The pocket tape 1 according to the invention so produced can then be rolled up or placed loosely in a package. It is also possible that the pocket tape 1 so produced is used immediately with a device as illustrated in FIG. 4 and FIG. 10. In this case it is possible to feed the carrier tape 4, illustrated in FIG. 10 and removed, i.e. pulled off via the diversion roller 10, to the device to the left as it is illustrated in FIG. 7 and thereby achieve an enclosed circuit for the carrier tape 4. It is also possible to wind up the pulled-off carrier tape 4 and to use it again for the production of adhesive tape 14 or pocket tape 1 according to the invention.

The invention claimed is:

1. A system for producing a pocket tape, the system comprising:

a carrier tape feeder for feeding a carrier tape;

a pocket tape feeder for feeding the pocket tape;

a transducer capable of providing a signal when a predetermined position on the pocket tape is detected by the transducer, the transducer including a wheel having one or more grooves, wherein the one or more grooves are constructed and arranged to receive at least a portion of the pocket tape;

a control device for receiving the signal from the transducer and, in response thereto, to cause an adhesive to be applied to at least one of the pocket tape or carrier tape to define adhesive zones spaced between non-adhesive zones, along the length of at least one of the pocket tape or carrier tape; and a mechanism for attaching the pocket tape to the carrier tape, wherein the adhesive is between the pocket tape and the carrier tape.

2. The system according to claim 1, wherein the transducer includes a pulse transducer.

3. The system according to claim 1, wherein the pocket tape includes at least one pocket including a starting edge; and the predetermined position of the pocket tape is substantially at the starting edge of the at least one pocket of the pocket tape.

4. The system according to claim 1, wherein the pocket tape includes at least one pocket; and the predetermined position of the pocket tape is substantially at the center of the at least one pocket of the pocket tape.

5. The system according to claim 1, wherein the pocket tape includes at least one pocket including a trailing end; and the predetermined position of the pocket tape is substantially at the trailing end of the at least one pocket of the pocket tape.

6. The system according to claim 1, wherein the pocket tape includes at least one pocket, wherein an object is contained within the at least one pocket, the object having a starting end; and the predetermined position of the pocket tape is substantially at the starting end of the object in the pocket.

7. The system according to claim 1, wherein the pocket tape includes at least one pocket, wherein an object is contained within the at least one pocket; and the predetermined position of the pocket tape is substantially at the center of the object in the pocket.

8. The system according to claim 1, wherein the pocket tape includes at least one pocket, wherein an object is contained within the at least one pocket, the object having a trailing end; and the predetermined position of the pocket tape is substantially at the trailing end of the object in the pocket.

* * * * *